US006965289B2

(12) United States Patent
Toi et al.

(10) Patent No.: US 6,965,289 B2
(45) Date of Patent: Nov. 15, 2005

(54) COMMON-MODE CHOKE COIL

(75) Inventors: Takaomi Toi, Machida (JP); Yoshio Hanato, Machida (JP); Tatsuyuki Yamada, Fukui-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 17 days.

(21) Appl. No.: 10/244,759

(22) Filed: Sep. 17, 2002

(65) Prior Publication Data

US 2003/0071704 A1 Apr. 17, 2003

(30) Foreign Application Priority Data

Sep. 18, 2001 (JP) ..... 2001-283697
Aug. 22, 2002 (JP) ..... 2002-242367

(51) Int. Cl.[7] ..... H01F 27/02

(52) U.S. Cl. ..... 336/83; 336/90; 336/96; 336/200; 336/223; 336/232; 336/212

(58) Field of Search ..... 336/83, 90, 96, 336/200, 212, 223, 232, 110, 181, 155, 172

(56) References Cited

U.S. PATENT DOCUMENTS 6,348,850 B1 * 2/2002 Kimura et al. ..... 336/200
6,483,409 B1 * 11/2002 Shikama et al. ..... 336/83
6,642,672 B2 * 11/2003 Hu et al. ..... 315/276
2001/0038327 A1 * 11/2001 Aoki et al. ..... 336/83

FOREIGN PATENT DOCUMENTS

| | | | |
|---|---|---|---|
| CN | 1391334 A | * | 6/2001 |
| JP | 355115311 A | * | 9/1980 |
| JP | 06-251946 | | 9/1994 |
| JP | 07-106137 | | 4/1995 |
| JP | 7-201580 | | 8/1995 |
| JP | 8-186028 | | 7/1996 |
| JP | 10-312921 | | 11/1998 |
| JP | 11-067520 | | 3/1999 |
| JP | 2000-311816 | | 11/2000 |
| JP | 2001-126913 | | 5/2001 |

OTHER PUBLICATIONS

English translation of Japanese Search Report dispatched on Feb. 1, 2005 regarding Japanese Patent Application No. 2002–242367.

* cited by examiner

*Primary Examiner*—Elvin Enad
*Assistant Examiner*—Jennifer A. Poker
(74) *Attorney, Agent, or Firm*—Keating & Bennett, LLP

(57) ABSTRACT

A common-mode choke coil includes a core having flanges disposed at both ends and a winding section arranged between the flanges. Electrodes are disposed in the flanges, while two pieces of wire are wound around the winding section and ends of the pieces of wire are connected to the electrodes. A ferrite plate with a relative magnetic permeability that is smaller than that of the core is attached on the upper surface of the flanges with an adhesive so as to cover the wire.

12 Claims, 6 Drawing Sheets

COMMON-MODE CHOKE COIL

BACKGROUND OF THE INVENTION

1. Field of the Invention

The present invention relates to a common-mode choke coil having a core and wire, and in particular, relates to a common-mode choke coil suitable for use in a common-mode filter for eliminating noise.

2. Description of the Related Art

In general, a wire-wound common-mode choke coil is known as a necessary radiant noise relief measure in a power supply line or as a common-mode noise relief measure of a high-frequency signal (Japanese Unexamined Patent Application Publication No. 2000-133522, for example). Such a common-mode choke coil utilizing a conventional technique includes a ferrite magnetic core with a winding core having flanges at both ends, a plurality of pieces of wire made of insulating coated-copper wire and wound around the winding core by several turns to several dozen turns in a bifilar winding manner, a magnetic shielding member (flat-plate core) connected between both the flanges of the magnetic core and having substantially the same permeability as that of the magnetic core. Also, in the both flanges or one of the flanges, a plurality of electrodes are arranged so as to be conductively connected to ends of the wire, the tongue and tail, by soldering or thermo-compression. In such a common-mode choke coil, a desired impedance value is obtained by appropriately setting the number of turns of the wire wound around the winding core.

Meanwhile, a new standard of an interface USB (Universal Series Bus) 2.0 between a personal computer and peripheral equipment has been introduced and is being used, so that the development of personal computers and peripheral equipment conforming to this standard is very active. The data-transmitting rate of the USB 2.0 is 480 Mbps, which is extremely high. Therefore, in designing the personal computers and peripheral equipment conforming to the interface USB 2.0 so as to deal with a signal line with a high frequency of 480 MHz, it is necessary to consider the distortion of a signal waveform and to particularly consider the prevention of radiant magnetic noise. As a result, in wiring on a main board of a personal computer, for example, it is necessary that the mismatching in impedance be eliminated, and common-mode noise produced by the signals transmitting in a plurality of pieces of wire in the same direction be prevented to minimize radiant magnetic noise in connectors.

In conforming to the pre-existing interface USB 1.1, a ferrite bead inductor is generally used for suppressing radiant magnetic noise in connectors. However, since the applicable frequencies of the ferrite bead inductor range up to substantially several dozen MHz, in the USB 2.0 operating at 480 MHz, the high-frequency component of a signal waveform is rather reduced. Therefore, in designing personal computers and peripheral equipment conforming to the interface USB 2.0, it is recommended to use a common-mode choke coil as a common-mode noise relief measure instead of the ferrite bead inductor.

However, because the applicable frequencies of a conventional common-mode choke coil are about several MHz to about 200 MHz, high-frequency common-mode noise in the interface USB 2.0 ranging from several hundred MHz to several GHz cannot be eliminated. Accordingly, the improvement of frequency characteristics in a common-mode impedance has been intensively demanded to enable the common-mode noise having a bandwidth of several hundred MHz or more to be eliminated.

On the other hand, in the use of a common-mode choke coil having high common-mode impedance characteristics for eliminating the common-mode noise having a bandwidth of several hundred MHz or more, the possibility of not satisfying EOP (End-Of-Packet) and an eye pattern in the USB code may exist.

In order to satisfy the EOP and the eye pattern in the USB code, the common-mode impedance must be reduced, and specifically, for satisfying the EOP and the eye pattern, a common-mode impedance of about 120 Ω or less (the optimum value is 90 Ω) is required for a signal of 100 MHz, for example. Whereas, in the conventional wire-wound common-mode choke coil, the number of turns of the wire can be only set to be an integral multiple of one turn, and the values of impedance are discontinuous, so that a desired impedance value may not be obtained. For example, in a coil having wire wound by three turns, an impedance of about 67 Ω is obtained for a signal of 100 MHz, whereas in a coil having wire wound by four turns, an impedance of about 120 Ω is obtained for a signal of 100 MHz, so that there is a difference of about 50 Ω therebetween. At this time, there has been a problem that the EOP and the eye pattern cannot be satisfied at 120 Ω while noise eliminating characteristics cannot be secured at 67 Ω.

Also, in a structure in which a magnetic shielding member having substantially the same permeability as that of the magnetic core is connected between the flanges of the magnetic core, the impedance value may change because of variations in the clearance size between the magnetic core and the magnetic shielding member or the displacement of the magnetic shielding member, so that there has also been a problem that the EPO and eye pattern are not satisfied.

SUMMARY OF THE INVENTION

In order to solve the problems of the conventional techniques described above, preferred embodiments of the present invention provide a common-mode choke coil which is capable of achieving a desired impedance value while having a small amount of deviation of the impedance value.

In order to solve the problems described above, a common-mode choke coil according to a preferred embodiment of the present invention includes a core having flanges disposed at both ends and a winding section arranged between the flanges, a plurality of pieces of wire wound around the winding section of the core, electrodes disposed in the flanges of the core to be connected to ends of the pieces of wire, and a magnetic shield with a relative magnetic permeability smaller than that of the core arranged between the flanges of the core so as to cover the pieces of wire.

By such a configuration, the magnetic shield has a relative magnetic permeability that is smaller than that of the core, so that the effective magnetic permeability of the entire coil can be reduced in comparison with that of the conventional coil in that a flat plate core having the same relative magnetic permeability as that of the core is arranged between two flanges. Therefore, by combining features of preferred embodiments of the present invention with the conventional coil, the degree of freedom of the impedance values of the coil is greatly increased, thereby setting the impedance to be a desired value, so that noise can be reliably eliminated from a transmission line. Also, because there is provided the magnetic shield with a relative magnetic permeability that is smaller than that of the core, even when changes in the shape and arrangement of the magnetic shield are produced, the impedance value can be set at a high degree of accuracy reducing deviation therein, while the yield can be improved. Furthermore, because the magnetic shield having the relative magnetic permeability that is smaller than that of the core is provided, a common-mode impedance value can be increased for a high frequency of about 100 MHz or more, for example, in comparison with when the flat-plate core having the same relative magnetic permeability as that of the core is formed according to the conventional technique, so that common-mode impedance characteristics can be improved.

Preferably, the magnetic shield includes a ferrite plate with both ends being connected to the flanges.

In this case, because of the ferrite plate attached to the flanges, the effective magnetic permeability of the entire coil and the impedance value can be set to be comparatively high values in comparison with a coil in that another material such as a resin material is used.

Preferably, the magnetic shield includes a magnetic powder-containing resin coating made of a resin material including magnetic powder.

Thereby, the magnetic powder-containing resin coating adheres to the core having the wire wound therearound so as to be firmly fixed thereon, thereby simplifying the manufacturing process so as to increase the productivity. Also, by adjusting the content of the magnetic powder, the relative magnetic permeability of the magnetic powder-containing resin coating can be changed, so that various impedance values can be easily set. Moreover, since the magnetic shield is made of the magnetic powder-containing resin coating, the height of the entire common-mode choke coil can be reduced to be smaller in comparison with when the flat-plate core is formed using the conventional technique. Also, the magnetic powder-containing resin coating adheres to the core having the wire wound therearound, so that the wire may be protected with the magnetic powder-containing resin coating while the wire is fixed so as to reduce the amount of deviation in the impedance value, thereby stabilizing the impedance value.

Preferably, the magnetic shield includes a resin coating made of a resin material with a relative magnetic permeability of approximately 1.

Thereby, the resin coating adheres to the core having the wire wound therearound so as to be firmly fixed thereon, simplifying the manufacturing process. Also, since the magnetic shield is made of the resin coating, the height of the entire common-mode choke coil can be reduced to be smaller in comparison with when the flat-plate core is formed according to the conventional technique. Furthermore, the resin coating adheres to the core having the wire wound therearound, so that the wire may be protected with the resin coating while the wire is fixed so as to reduce the amount of deviation in the impedance value, stabilizing the impedance value. Also, since the magnetic shield is made of the resin coating with a relative magnetic permeability of approximately 1, a common-mode impedance value can be increased for a high frequency of 100 MHz or more, for example, in comparison with when the flat-plate core having the same relative magnetic permeability as that of the core is provided as in the conventional technique, so that common-mode impedance characteristics can be improved.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Preferred embodiments of a common-mode choke coil according to the present invention will be described in detail below with reference to the attached drawings.

Figure 1:
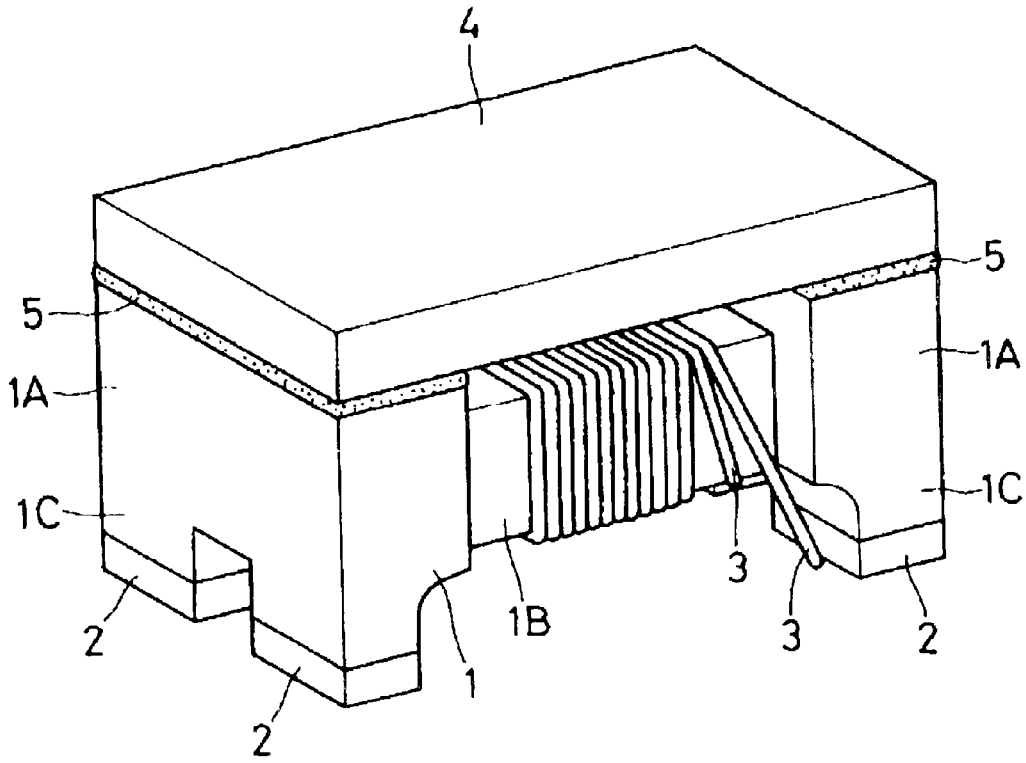
FIG. 1 is a perspective view of a common-mode choke coil according to a first preferred embodiment of the present invention.
Figure 2:
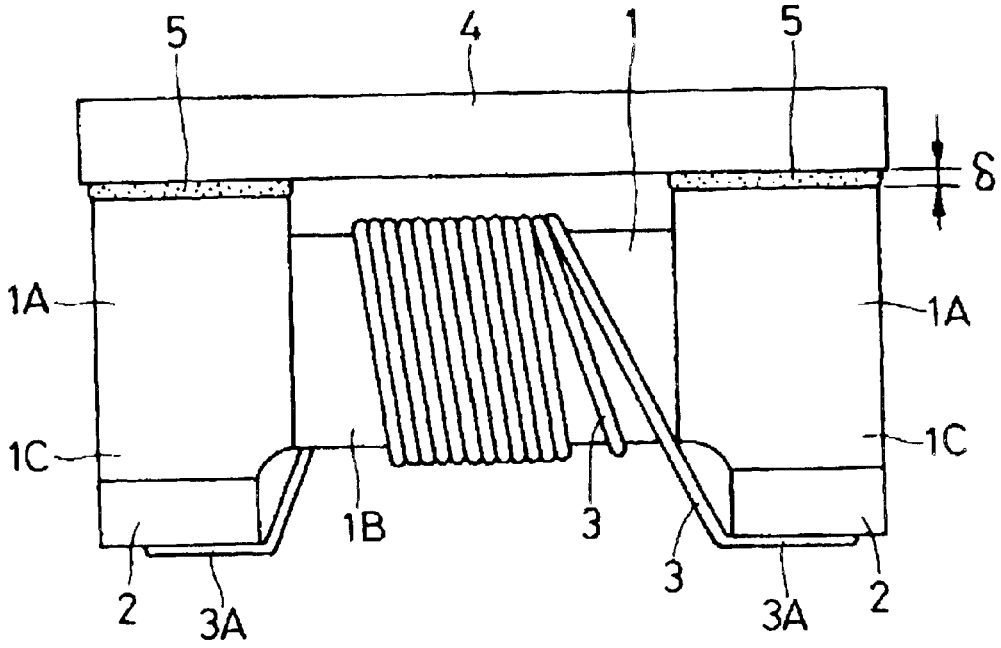
FIG. 2 is a front view of the common-mode choke coil shown in FIG. 1.
Figure 3:
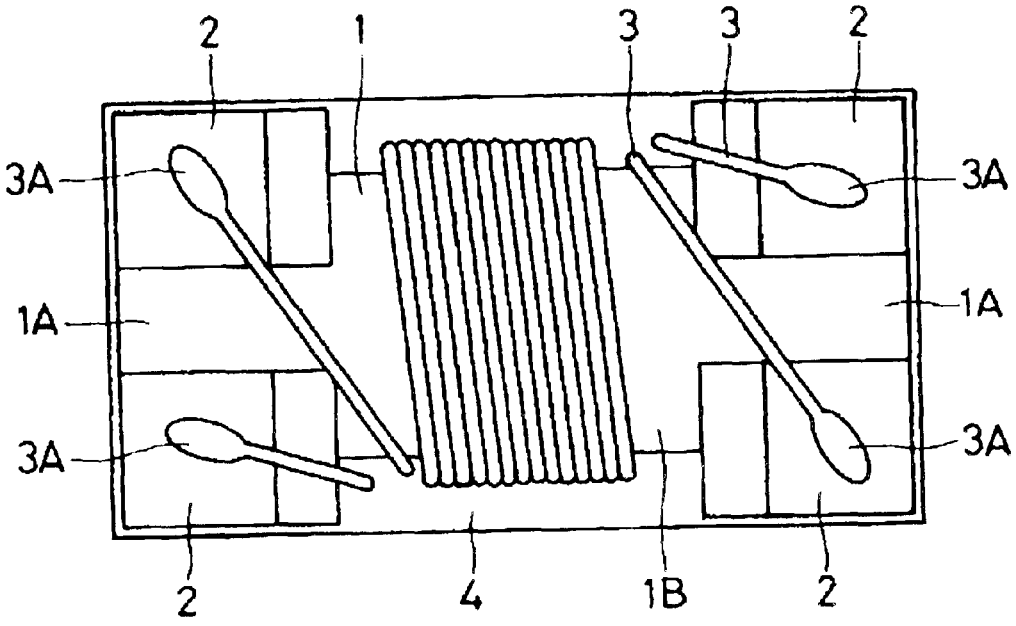
FIG. 3 is a bottom view of the common-mode choke coil shown in FIG. 1.

FIGS. 1 to 3 show a first preferred embodiment, and a substantially prism-shaped core 1 includes large-diameter flanges 1A arranged at both ends and a small-diameter winding section 1B disposed between the two flanges 1A. The core 1 is preferably made of a magnetic material such as ferrite, and preferably has a relative magnetic permeability of about 200 $\mu c$ to about 500 $\mu c$. In the bottom portion of each of the flanges 1A, a leg 1C which is forked into two parts is provided, and a curved notch is disposed between each of the legs 1C and the winding section 1B.

An electrode 2 disposed at the bottom portion of each leg 1C is preferably provided by forming electrode layers of nickel and tin with soldering on a base-electrode layer, which is formed by applying and sintering conductive paste such as silver and copper at first. The electrode 2 is also preferably formed to have a height of about 0.1 mm or more, for example, in order to form a solder fillet between an electrode pad on a substrate (not shown) and the electrode 2 when the common-mode choke coil is attached on the substrate. The film thicknesses of the electrode 2 are preferably about 10 $\mu$m to about 30 $\mu$m for the base electrode layer, about 1 $\mu$m to about 5 $\mu$m for the nickel layer, and about 5 $\mu$m to about 24 $\mu$m for the tin layer in order to securely connect to a wire 3, which will be described later.

The wire 3 made of a conductive metallic material is wound around the winding section 1B by bifilar winding, in which two pieces of wire arranged together are wound. Both ends 3A of the wire 3 are connected to the electrodes 2 disposed at bottom ends of the flanges 1A by a bonding member such as thermo-compression bonding. The wire 3 is also wound by an arbitrary number of turns (about 3 to 10 turns, for example) corresponding to the required impedance value.

A ferrite plate 4 arranged between the two flanges 1A so as to cover the wire 3 as a magnetic shield is preferably made of a magnetic material such as ferrite and has a substantially rectangular-plate shape. Both ends of the ferrite plate 4 are fixed on upper surfaces of the flanges 1A, which are opposite to the bottom surfaces, with an adhesive 5, which will be described later. The ferrite plate 4 also has an external dimension that is preferably larger than that of the core 1 by about 0.1 mm to about 0.2 mm for absorbing the displacement produced by the bonding to the core 1.

The relative magnetic permeability $\mu s$ of the ferrite plate 4 is preferably smaller than that $\mu c$ of the core 1 ($\mu s<\mu c$). In order to reliably reduce the effective magnetic permeability of the entire coil, it is preferable that the relative magnetic permeability $\mu s$ of the ferrite plate 4 be reduced by about half or less of that $\mu c$ of the core 1 ($\mu s$=20 to 40, for example). Thereby, the impedance value Zc of the coil can be largely reduced in comparison with a case that the relative magnetic permeability $\mu s$ of the ferrite plate 4 is substantially the same as that $\mu c$ of the core 1.

The adhesive 5 for bonding the ferrite plate 4 to the flanges 1A of the core 1 is preferably made of an epoxy thermosetting adhesive. After at least one of bonding surfaces between the core 1 and the ferrite plate 4 is coated with the adhesive 5, the ferrite plate 4 is bonded to the core 1 and then, they are cured by heating at about 150° C. in this state.

The adhesive 5 also separates the ferrite plate 4 from the flanges 1A by a spacing $\delta$. The spacing $\delta$ is preferably about 0.3 mm or less, for example. Because the magnetic saturation is thereby difficult to be produced, the impedance value Zc of the coil can be set with a high degree of accuracy.

In addition, the adhesive 5 is preferably made of a thermosetting resin material. Alternatively, an ultraviolet curing resin material may be used.

The common-mode choke coil according to the present preferred embodiment is preferably configured as described above, so that noise can be eliminated from a transmission line by bonding the electrodes 2 of the coil to the transmission line of a substrate (not shown).

Still, according to the present preferred embodiment, since the ferrite plate 4 having a relative magnetic permeability $\mu s$ smaller than that $\mu c$ of the core 1 ($\mu s<\mu c$) is arranged between the two flanges 1A, by combining with a coil in which the relative magnetic permeability $\mu s$ of the ferrite plate 4 is substantially the same as that $\mu c$ of the core 1, for example, the degree of freedom of the impedance value Zc of the coil can be increased.

That is, when the relative magnetic permeability $\mu s$ of the ferrite plate 4 is preferably substantially the same as that $\mu c$ of the core 1 ($\mu c=\mu s$), for example, in a coil having wire wound by three turns, an impedance value Zc of about 67 Ω is obtained for 100 MHz, and in a coil having wire wound by four turns, an impedance value Zc of about 120 Ω is obtained for 100 MHz, whereas according to the present preferred embodiment, since the relative magnetic permeability $\mu s$ of the ferrite plate 4 is reduced by about half or less of that $\mu c$ of the core 1 ($\mu s \leqq \mu c/2$), for example, by being wound by five turns, an impedance value Zc of about 90 Ω for 100 MHz can be set, so that the range of choice for the impedance value Zc is increased.

As a result, because the impedance value Zc of a coil can be set to a desired value, noise can be reliably eliminated from a transmission line by connecting the coil to the transmission line.

Also, the relative magnetic permeability $\mu s$ of the ferrite plate 4 is preferably smaller than that $\mu c$ of the core 1, so that even when the spacing $\delta$ due to the adhesive 5 changes, changes in the impedance value Zc can be prevented.

That is, when the relative magnetic permeability $\mu s$ of the ferrite plate 4 is substantially the same as that $\mu c$ of the core 1 ($\mu c \approx \mu s$), the impedance value Zc changes by about 34% for a change of about 0.1 mm in the spacing $\delta$ of the adhesive 5, for example. Whereas, according to the present preferred embodiment, since the relative magnetic permeability $\mu s$ of the ferrite plate 4 is reduced by about half or less of that $\mu c$ of the core 1 ($\mu s \leqq \mu c/2$), even when the spacing $\delta$ of the adhesive 5 changes by about 0.1 mm, the variation in the impedance value Zc can be suppressed to a degree of about 16%. Therefore, the deviation in the impedance value Zc can be reduced by about half, so that the impedance value Zc can be set with a high degree of accuracy while the yield can be improved.

Also, since the ferrite plate 4 is provided as a magnetic shield according to the present preferred embodiment, the relative magnetic permeability $\mu s$ of the ferrite plate 4 can be set to be rather large as compared to the relative magnetic permeability $\mu c$ of the core 1 ($\mu s$=0.1 $\mu c$ to 0.5 $\mu c$, for example). Therefore, in comparison with using another material such as a resin material, the effective permeability and the impedance value Zc of the coil can be maintained to be large. Furthermore, since the ferrite plate 4 covers the upper surface of the core 1, the upper surface of the wire 3, which is liable to be exposed to the outside, can be protected with the ferrite plate 4.

Furthermore, since the relative magnetic permeability $\mu s$ of the ferrite plate 4, which is the magnetic shield, is smaller than that $\mu c$ of the core 1, a common-mode impedance value can be increased for a high frequency of 100 MHz or more, for example, in comparison with when the flat-plate core having substantially the same relative magnetic permeability as that of the core is provided as in the conventional technique, so that common-mode impedance characteristics are greatly improved.

Figure 4:
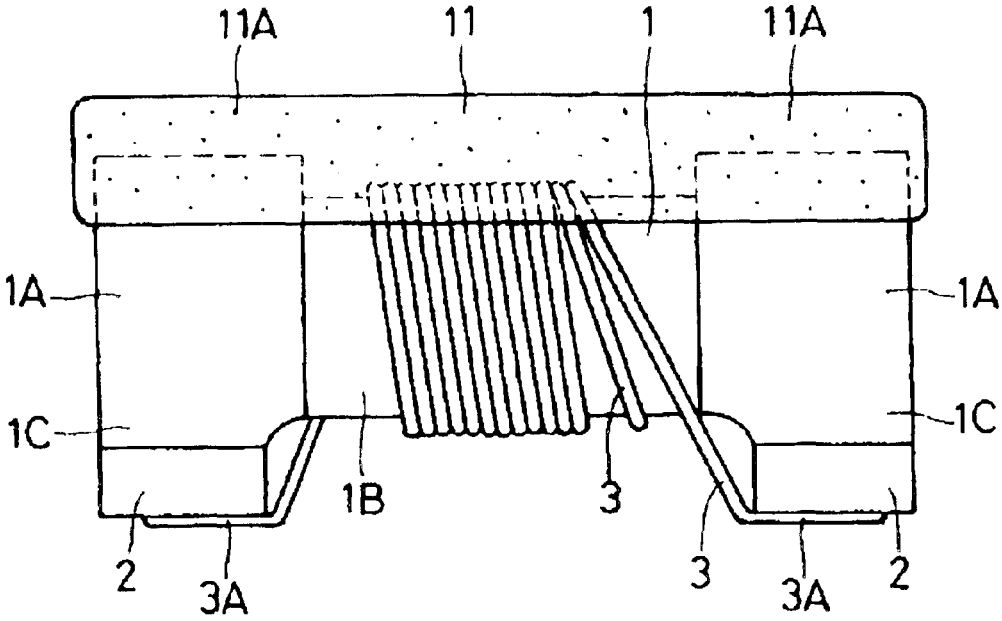
FIG. 4 is a front view of a common-mode choke coil according to a second preferred embodiment of the present invention.

Next, FIG. 4 shows a common-mode choke coil according to a second preferred embodiment of the present invention. One of the unique features of this preferred embodiment is that the magnetic shield is preferably made of a magnetic powder-containing resin coating made of a resin material including magnetic powder. In addition, like reference characters designate like members common to those of the first preferred embodiment, and the description thereof is omitted.

A magnetic powder-containing resin coating 11 disposed on the upper surface of the core 1 is preferably made of a reliable epoxy resin material with high adhesiveness-containing magnetic powder 11A made of a magnetic material. The magnetic powder-containing resin coating 11 adheres to the flanges 1A of the core 1 and the winding section 1B having the wire 3 wound therearound so as to cover these elements, and a portion of the coating 11 extends vertically so as to approach side surfaces (walls) of the flanges 1A and the winding section 1B.

In the magnetic powder-containing resin coating 11, by adjusting the content of the magnetic powder 11A, the relative magnetic permeability $\mu s$ is appropriately set, wherein when the relative magnetic permeability $\mu s$ is set to be about 5 ($\mu s \approx 5$), for example, variations in the impedance value Zc are minimized.

In addition, the magnetic powder-containing resin coating 11 may be made of a thermosetting or ultraviolet-curing resin material.

As described above, this preferred embodiment also achieves the same advantages as those of the first embodiment. Furthermore, according to the present preferred embodiment, the magnetic shield is preferably made of the magnetic powder-containing resin coating 11, so that variations in the entire shape of the magnetic powder-containing resin coating 11 with respect to each coil can be reduced although the thickness thereof is slightly changed. Therefore, the range of variations in the impedance value Zc can be easily reduced, thereby setting the impedance value Zc with a high degree of accuracy.

According to the present preferred embodiment, the magnetic shield is preferably made of the magnetic powder-containing resin coating 11 including the magnetic powder 11A, so that the bonding the ferrite plate to the core as in the first preferred embodiment can be omitted, enabling the productivity to be increased and manufacturing cost to be reduced. Moreover, since the magnetic powder-containing resin coating 11 adheres to the core 1, the height of the entire coil can be reduced, achieving a coil applicable to a product with a small mounting space such as a portable terminal.

Also, the magnetic powder-containing resin coating 11 adheres to the core 1 having the wire 3 wound therearound, so that the wire 3 may be protected with the magnetic powder-containing resin coating 11. Furthermore, since the wire 3 can be fixed with the magnetic powder-containing resin coating 11, the displacement of the wire 3 is prevented so as to reduce the amount of deviation in the impedance value, thereby stabilizing the impedance value.

Figure 5:
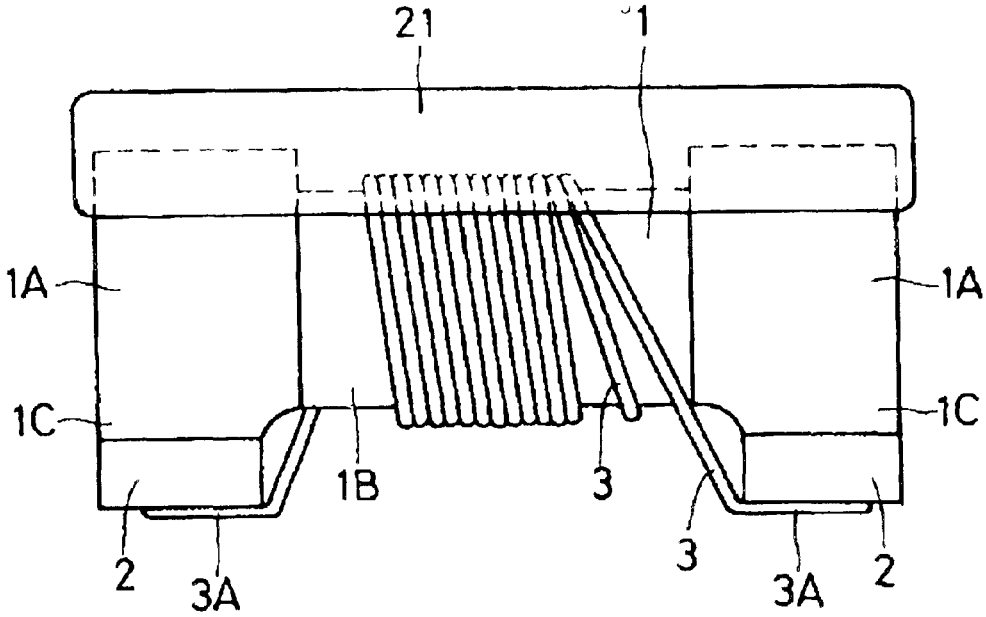
FIG. 5 is a front view of a common-mode choke coil according to a third preferred embodiment of the present invention.

Next, FIG. 5 shows a common-mode choke coil according to a third preferred embodiment of the present invention. One of the unique features of this preferred embodiment is that the magnetic shield is made of a resin coating made of a resin material having a relative magnetic permeability $\mu s$ of about 1. In addition, like reference characters designate like members common to those of the first preferred embodiment, and the description thereof is omitted.

A resin coating 21 disposed on the upper surface of the core 1 is preferably made of a thermosetting or ultraviolet-curing epoxy resin material. The resin coating 21 adheres to the flanges 1A of the core 1 and the winding section 1B having the wire 3 wound therearound so as to cover these elements, and a portion of the coating 21 extends vertically so as to approach side surfaces (walls) of the flanges 1A and the winding section 1B. The relative magnetic permeability $\mu s$ of the resin coating 21 is preferably about 1 ($\mu s \approx 1$).

As described above, this preferred embodiment can also achieve the same advantages as those of the first preferred embodiment. Furthermore, according to the present preferred embodiment, the resin coating 21 having a comparatively small relative magnetic permeability $\mu s$ is attached to the core 1, so that variations in the impedance value Zc due to variations in the shape of the resin coating 21 are minimized, thereby improving the degree of accuracy in setting the impedance value Zc.

Since the resin coating 21 adheres to the core 1 to be cured, any component such as the ferrite plate as in the first preferred embodiment is not required and an inexpensive resin material can be used, thereby enabling the manufacturing cost to be reduced.

Furthermore, since the resin coating 21 adheres to the core 1, the height of the entire coil can be reduced, achieving a coil applicable also to a product with a small mounting space such as a portable terminal. Also, the resin coating 21 adheres to the core 1 having the wire 3 wound therearound, so that the wire 3 may be protected with the resin coating 21, while the wire 3 can be fixed so as to reduce the amount of deviation in the impedance value, thereby stabilizing the impedance value.

Also, the magnetic shield is made using the resin coating 21 with the relative magnetic permeability $\mu s$ set to be approximately 1 ($\mu s \approx 1$), so that a common-mode impedance value can be increased for a high frequency of 100 MHz or more, for example, in comparison with when the flat-plate core having substantially the same relative magnetic permeability as that of the core is provided as in the conventional technique.

The core 1 is preferably about 2.0 mm in length, about 1.2 mm in width, about 0.8 mm in height, and about 400 in the relative magnetic permeability $\mu c$, for example. The wire 3 with a diameter of about 40 $\mu m$ is wound around the core 1 by 4 turns in a bifilar winding manner. A ferrite plate with a relative magnetic permeability $\mu s$ of about 400, a length of about 2.0 mm, a width of about 1.2 mm, and a height of about 0.3 mm is bonded on the core 1 in the state so as to form a coil using a conventional technique. At this time, the height of the coil is approximately 1.1 mm.

Figure 6:
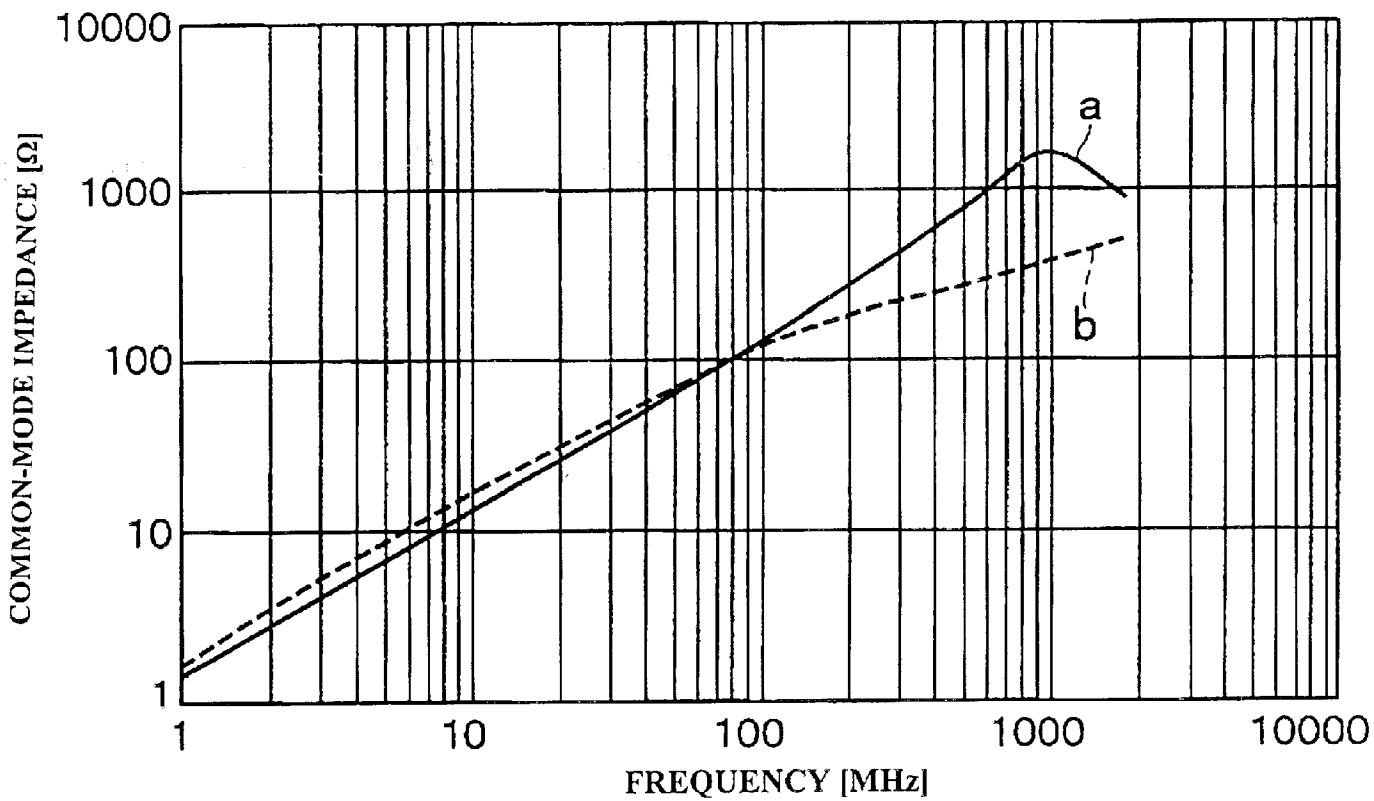
FIG. 6 is a characteristic graph showing the relationship between frequencies of the common-mode choke coil according to the third preferred embodiment and common-mode impedances.

In such a conventional coil, as shown in a characteristic curve b indicated by a dotted line in FIG. 6, the common-mode impedance of the coil has a tendency to be saturated in the frequency band higher than 100 MHz. As a result, in the high frequency band higher than several hundred MHz, the common-mode impedance value decreases, so that common-mode noise cannot be sufficiently eliminated.

Whereas, according to the present preferred embodiment, the resin coating 21 made of an epoxy resin and having a relative magnetic permeability $\mu s$ of approximately 1 ($\mu s \approx 1$) is preferably disposed on the core 1 having the same shape and the wire 3 with a diameter of about 40 $\mu m$ wound therearound by 7 turns in a bifilar winding manner. At this time, the height of the coil is approximately 0.8 mm.

In such a coil according to the present preferred embodiment, as shown in a characteristic curve a indicated by a solid line in FIG. 6, in the frequency band higher than 100 MHz, the common-mode impedance is increased by about several dozen Ω to about several hundred Ω in comparison with the conventional coil, so that common-mode impedance characteristics are improved. In particular, the effect on the improvement in the impedance characteristics is remarkable when the resin coating 21 having a relative magnetic permeability $\mu s$ of approximately 1 is provided as in the present preferred embodiment, in comparison with the first and second preferred embodiments. Consequently, even in the high frequency band higher than several hundred MHz, common-mode noise can be sufficiently eliminated.

Figure 7:
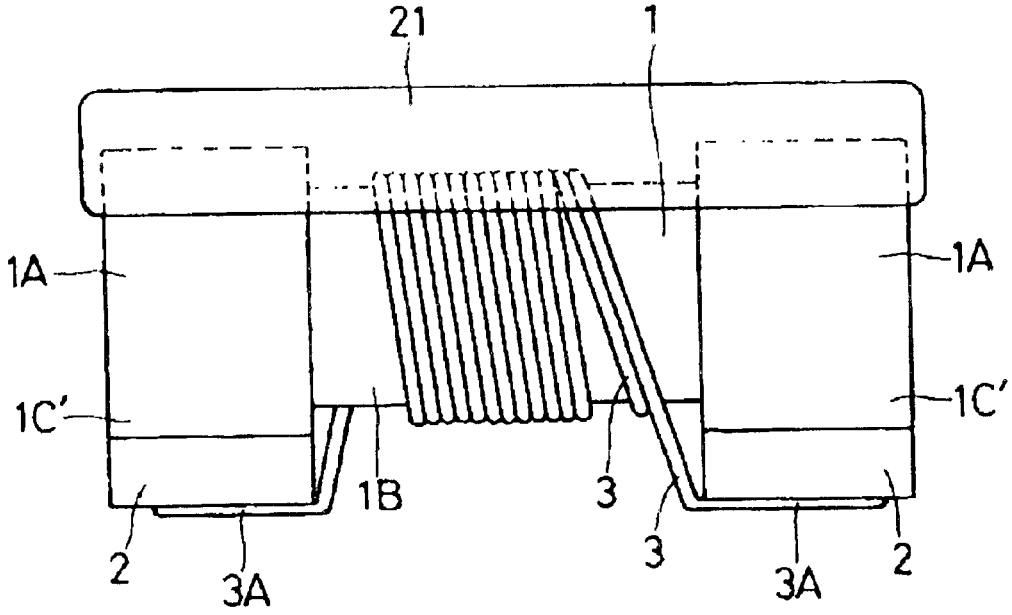
FIG. 7 is a front view of a common-mode choke coil according to a first modification of preferred embodiments of the present invention.

According to the preferred embodiments described above, the curved notch is disposed between each of the legs 1C and the winding section 1B. Alternatively, as a first modification shown in FIG. 7, a leg 1C' may be provided, which is laterally forked from the bottom of the flange 1A with the same length as that of the flange 1A eliminating the curved notch.

Figure 8:
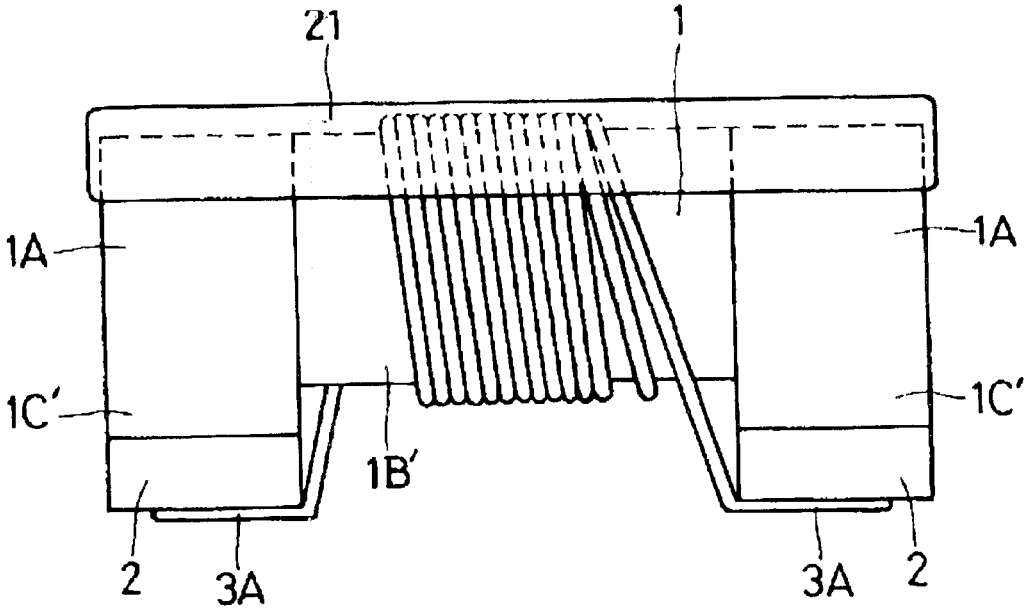
FIG. 8 is a front view of a common-mode choke coil according to a second modification of preferred embodiments of the present invention.

Also, according to the preferred embodiments described above, the winding section 1B is arranged at an intermediate position in the vertical direction of the flanges 1A. Alternatively, as a second modification shown in FIG. 8, a winding section 1B' may be arranged at the top position in the vertical direction for the flanges 1A. In this case, the top surfaces of the flanges 1A are flush with the top surface of the winding section 1B' while a portion of the wire 3 is protruded from the top surface of the winding section 1B', so that it is preferable to provide a magnetic powder-containing resin coating (not shown) or the resin coating 21 on the upper side of the core 1.

Figure 9:
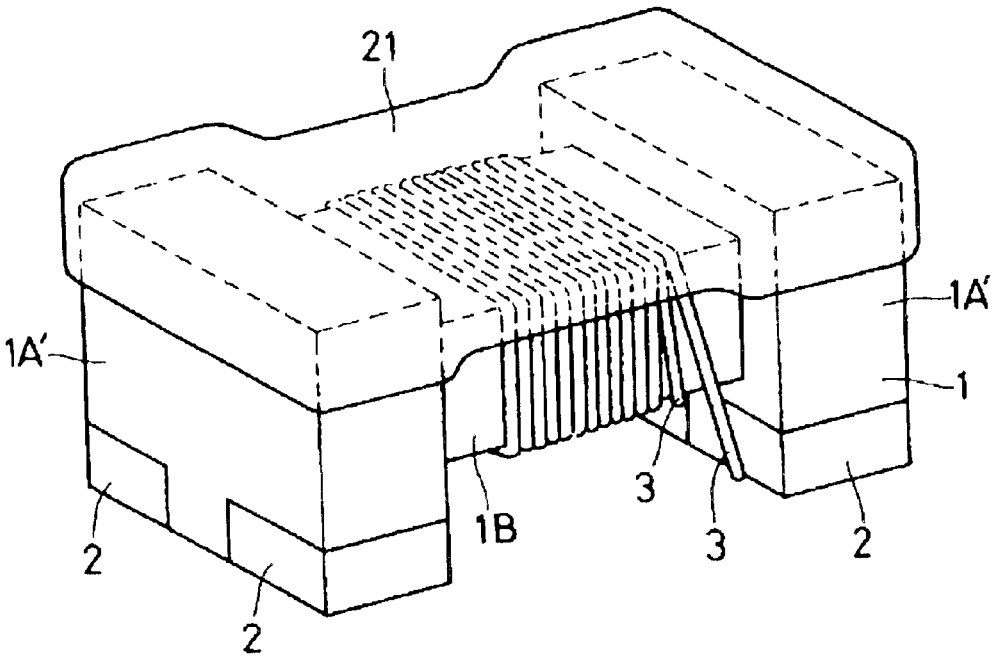
FIG. 9 is a perspective view of a common-mode choke coil according to a third modification of preferred embodiments of the present invention.

Furthermore, according to preferred embodiments described above, in the bottom portion of each of the flanges 1A, the leg 1C forked into two parts is provided, and the electrode 2 is disposed on the bottom surface of the leg 1C. Alternatively, as a third modification shown in FIG. 9, substantially rectangular flanges 1A' may be provided thus omitting the legs while substantially square electrodes 2 may be directly attached on the bottom surfaces of the flanges 1A'.

Figure 10:
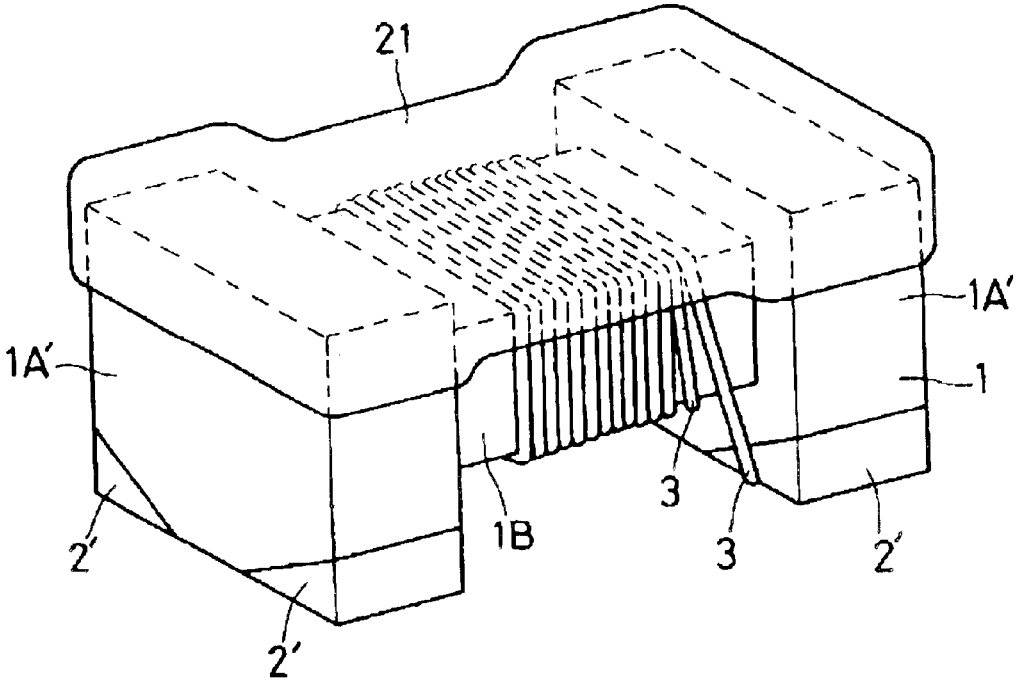
FIG. 10 is a perspective view of a common-mode choke coil according to a fourth modification of preferred embodiments of the present invention.

In this case, alternatively, as a fourth modification shown in FIG. 10, in view of the manufacturing facility, substantially triangular electrodes 2' may be attached on the bottom surfaces of the flanges 1A'.

Also, according to preferred embodiments described above, two pieces of the wire 3 are preferably wound around the winding section 1B. Alternatively, three or more pieces of wire may be wound. Furthermore, the winding manner of the wire 3 is not limited to the bifilar winding. Alternatively, a plurality of pieces of wire may be independently wound.

Also, according to preferred embodiments described above, as the magnetic shield, the ferrite plate 4, the magnetic powder-containing resin coating 11, and the resin coating 21 are preferably attached on the upper surface of the core 1. Alternatively, a magnetic shield having a substantially U-shaped cross-section so as to cover both sides and the upper surface of the core may be attached to the core.

Moreover, according to the first preferred embodiment, the ferrite plate 4 is preferably attached to the core 1. However, the present invention is not limited to this and a plate made of another magnetic material may be attached to the core.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A common-mode choke coil comprising:

a core including flanges disposed at both ends thereof and a winding section arranged between the flanges;

a plurality of pieces of wire wound around the winding section of the core;

electrodes disposed in the flanges of the core to be connected to ends of the pieces of wire; and a magnetic shield with a relative magnetic permeability that is smaller than that of the core arranged between the flanges of the core so as to cover the pieces of wire; wherein the magnetic shield includes a resin coating made of a resin material with a relative permeability of approximately 1;

the resin coating is disposed on upper surfaces of the flanges of the core and an upper surface of the winding section of the core; and portions of side surfaces and a lower surface of the winding section of the core are provided without the resin coating.

2. A coil according to claim 1, wherein the core has a substantially prism-shaped configuration.

3. A coil according to claim 1, wherein the core is made of ferrite.

4. A coil according to claim 1, wherein the core is made of a magnetic material having a relative magnetic permeability of about 200 $\mu c$ to about 500 $\mu c$.

5. A coil according to claim 1, wherein in a bottom portion of each of the flanges, a leg which is forked into two parts is provided, and a curved notch is disposed between each of the legs and the winding section.

6. A coil according to claim 5, wherein an electrode is provided at the bottom portion of each of the legs.

7. A coil according to claim 1, wherein the ferrite plate has an external dimension that is larger than that of the core.

8. A coil according to claim 1, wherein the plurality of pieces of wire are wound around the core in a bifilar winding configuration.

9. A coil according to claim 1, wherein in a bottom portion of one of the flanges, a leg which is forked into two parts is provided.

10. A coil according to claim 1, wherein the winding section is located at an intermediate position in a vertical direction of the flanges.

11. A coil according to claim 1, wherein the winding section is located at the top position in a vertical direction of the flanges.

12. A coil according to claim 1, wherein the flanges are substantially rectangular and include substantially square electrodes disposed on bottom surfaces of the flanges.

* * * * *